US006387030B1

(12) United States Patent
Moore et al.

(10) Patent No.: US 6,387,030 B1
(45) Date of Patent: May 14, 2002

(54) INTERNAL ADAPTER WITH A PELLET WELL FOR A CENTRIFUGE CONTAINER

(75) Inventors: Patrick Q. Moore, Gilroy; Shahla Sheikholeslam, Los Altos, both of CA (US)

(73) Assignee: Beckman Coulter, Inc., Fullerton, CA (US)

( * ) Notice: Subject to any disclaimer, the term of this patent is extended or adjusted under 35 U.S.C. 154(b) by 0 days.

(21) Appl. No.: 09/608,177

(22) Filed: Jun. 30, 2000

(51) Int. Cl.[7] ..... B04B 5/02

(52) U.S. Cl. ..... 494/20; 494/16; 494/45; 422/72; 422/102

(58) Field of Search ..... 422/72, 102; 494/16, 494/20, 45

(56) References Cited

U.S. PATENT DOCUMENTS

| | | | | |
|---|---|---|---|---|
| 3,266,718 | A | 8/1966 | Stahl et al. | |
| 3,578,240 | A | 5/1971 | Eberle | |
| 4,098,456 | A | 7/1978 | Bayham | |
| 4,451,250 | A | 5/1984 | Romanauskas | 494/85 |
| 4,698,411 | A | 10/1987 | Hall et al. | 436/10 |
| 4,990,129 | A | 2/1991 | Nielsen | 494/20 |
| 5,030,215 | A | 7/1991 | Morse et al. | 604/410 |
| 5,310,527 | A | 5/1994 | Romanauskas et al. | 422/102 |
| 5,422,018 | A | 6/1995 | Saunders et al. | 210/787 |
| 6,019,716 | A | 2/2000 | Forestell et al. | 494/21 |

*Primary Examiner*—David A. Reifsnyder
(74) *Attorney, Agent, or Firm*—William H. May; Arnold Grant; Hogan & Hartson, LLP

(57) ABSTRACT

A removable adapter for a centrifuge container is described. The adapter has an opening on top, an exterior surface and an interior surface. The exterior surface of the adapter body completely conforms to the bottom portion of the centrifuge container cavity. The interior surface of the adapter body has an internal sidewall and a bottom with a pellet well. The pellet well extends downwardly, toward the exterior surface. Also, an assembly is disclosed, including the adapter of the present invention with a pellet well and a liner, conforming to the interior surface of the adapter, once inside the adapter. Also provided by the present invention is a method for separating solids from suspensions by centrifugation. In this method, the removable adapter with a pellet well of the present invention is placed into a centrifuge container. Then, the suspension is placed into the centrifuge container. When centrifugation is completed, the pellet is removed from the pellet well. The method may include an additional step of placing a liner into the adapter prior to the placing the suspension into the centrifuge container.

19 Claims, 1 Drawing Sheet

INTERNAL ADAPTER WITH A PELLET WELL FOR A CENTRIFUGE CONTAINER

AREA OF THE ART

The present invention is generally directed to adapters and disposable liners for centrifuge containers. More particularly, this invention is directed to adapters and liners that localize pellet formation, thus increasing the recovery of pelleted material.

DESCRIPTION OF THE PRIOR ART

Centrifugation is a widely used method for separating solid and liquid phases of suspensions. The solid phase is more dense than the liquid phase, and during centrifugation, solids settle at the bottom of the centrifuge container, forming a dense pellet. The lighter liquid phase forms a top layer, also called a supernatant. At the end of centrifugation, the supernatant can be decanted and the pellet harvested or discarded. The initial separation step may be followed by wash steps. During a wash step, the pellet is resuspended in a wash liquid. The resuspended solid component then may be pelleted once again by means of centrifugation and the supernatant wash liquid decanted from the container. In certain applications, this step can be repeated several times with the same or a different wash liquid.

Currently, tube-carrying rotors, as well as bowl-type centrifuge rotors, are available on the market. The following discussion is limited to tube-carrying rotors of which there are three main types: swinging bucket rotors, fixed angle rotors, and vertical tube rotors. All three types of tube-carrying rotors include a plurality of symmetrically located cavities, adapted to receive sample containers. Sample containers for centrifugation are manufactured in a variety of sizes, materials, wall thicknesses, and sealing means to accommodate chemically and pathogenically active samples and a wide range of operating conditions.

The existing designs of centrifuge containers, however, do not offer an easy access to pellets for their harvesting or disposal. In some applications, sample containers have to be cut to retrieve a pellet, which is not always an economically feasible option. In applications dealing with diluted suspensions, such as cell cultures, forming a concentrated pellet, by itself, can be a difficult task, let alone harvesting of such a small pellet from conventional centrifuge containers. In such samples, as a result of centrifugation, a very thin layer of solids becomes spread over a large surface of the container. In order to recover the pellet, it has to be scraped from the walls of the container, leaving some pelleted materials behind. Such a procedure reduces the percentage of pelleted material recovery and increases the chance of cross-contamination. Furthermore, the container would then need to be washed and autoclaved for the next run.

Cleaning of the centrifuge containers from the solids remaining on the walls after the pellet is harvested requires laborious and tedious scrubbing and washing. The difficulty of thorough cleaning of the centrifuge container further increases as the dimensions of the neck opening of the container decreases. That is, whereas some types of solid residue may be easily cleaned from wide-mouthed bottles, such residue becomes more difficult to remove where the bottle is of narrow-mouthed construction.

The manufacturing of conventional centrifuge containers requires that materials are selected according to their structural strength and fatigue resistance, and not necessarily for their chemical or sterilization resistance. However, the mechanical strength of the materials does not always correspond to their chemical and physical resistance. Consequently, certain chemically aggressive materials cannot be processed in conventional centrifuge containers or require bulky and expensive designs.

Conventional centrifuge containers cannot accommodate applications where the pellet is a hazardous material (e.g., a biohazard) and a minimal direct handling of the pellet by a technician is desirable. Also, when an aseptic procedure is called for, the centrifuge containers have to be sterilized, which often takes 30–60 minutes. This relatively long preparation time of a conventional centrifuge container further decreases efficiency of the sample processing.

The conventional centrifuge container designs, therefore, fail to provide convenient methods for precipitating solids into small, concentrated pellets by centrifugation and their efficient recovery. They also do not accommodate aseptic harvesting of suspended solids by centrifugation with little or no time required for cleaning and sterilization of the containers prior to the next centrifugal cycle.

SUMMARY OF THE INVENTION

Accordingly, it is an object of the present invention to develop a cost-efficient, rapid and convenient method for the separation of the solids from suspensions by centrifugation. Particularly, it is an object of the present invention to develop a centrifuge container adapter that allows efficiently collected solids from suspensions by forming localized, concentrated pellets. It is also an object of the present invention to provide an assembly of the centrifuge container adapter and a liner that minimizes the time required for cleaning of the centrifuge container, reduces direct exposure of a technician to hazardous pellets and, at the same time, increases the efficiency of the pellet harvesting.

These and other objects and advantages are achieved in the adapter of the present invention having a hollow body with an opening on top, an exterior surface and an interior surface. The adapter is designed for placement inside a cavity of a centrifuge container. Typically, centrifuge container cavities have a closed bottom portion and an open upper portion. The exterior surface of the adapter body completely conforms to the bottom portion of the centrifuge container cavity. The interior surface of the adapter body has an internal sidewall and a bottom with a pellet well. The pellet well extends downwardly, toward the exterior surface.

In one embodiment, a portion of the internal sidewall tapers toward the pellet well. Alternatively, the entire interior surface of the adapter may taper from the adapter opening toward the pellet well. In one embodiment, the interior surfaces comprise a plurality of cylindrical and conical internal sidewalls, formed one on top of the other and having different or the same tapers.

The size of the well may be varied to accommodate different concentrations of the suspended solid materials. Preferably, the capacity of the well should be sufficient to harvest substantially all suspended solids.

In another aspect, the present invention provides an assembly for use with a centrifuge container. The assembly includes the adapter of the present invention described above and a liner, conforming to the interior surface of the adapter, once inside the adapter. In the preferred embodiment, the liner has a height equal or larger than the depth of the interior of the adapter body.

The present invention also overcomes deficiencies of the prior techniques by providing a novel method for separating the solids from suspensions by utilizing the adapter of the instant invention. In this method, the removable adapter with a pellet well of the present invention is placed into a centrifuge container. Then, the suspension is placed into the centrifuge container. When centrifugation is completed, the pellet is removed from the pellet well. The method may include an additional step of placing a liner conforming to the interior of the adapter into the adapter prior to placing the suspension into the centrifuge container. The liner is removed from the container with the pelleted solids contained in the bottom portion of the liner. The pelleted solids on the liner may be either harvested or discarded.

The present invention has been found to provide a number of advantages. The adapter with a pellet well for centrifuge container can be used to recover the solids from a broad range of suspensions, which includes, but is not limited to, biological materials, such as cell lysates, blood, urine, and culture media. The invention is particularly advantageous in applications dealing with the recovery of solids from diluted samples, as it allows the concentration of the solids into a compact pellet. In contrast, the centrifugation of suspensions with a low concentration of suspended solids in conventional centrifuge containers leads to spreading of a very thin layer of the solids over a large surface of the centrifuge container, making the harvesting of the solids hard, if not impossible.

The adapter of the present invention can be designed to fit a wide variety of centrifuge containers, including, but not limited to, centrifuge containers used in a swinging bucket, vertical tube, and fixed angle rotors. For additional convenience, an assembly of the adapter of the present invention with a liner conforming to the interior of the adapter may be used. The liner of this invention can be made disposable, which eliminates the need for the mechanical cleaning of the centrifuge container and the adapter. The disposable liners can be sterilized to accommodate the aseptic sample processing.

The present invention is defined in its fullest scope in the appended claims and is described below in its preferred embodiments.

DESCRIPTION OF THE FIGURES

The above-mentioned and other features of this invention and the manner of obtaining them will become more apparent, and will be best understood by reference to the following description, taken in conjunction with the accompanying drawings, in which.

DETAILED DESCRIPTION OF THE INVENTION

Figure 1:
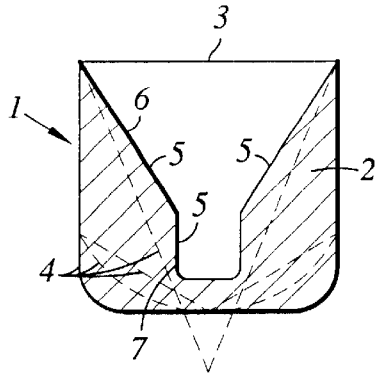
FIG. 1 is a cross-section of the centrifuge container adapter showing various configurations of the outer surface of the adapter in accordance with embodiments of the present invention.
Figure 2:
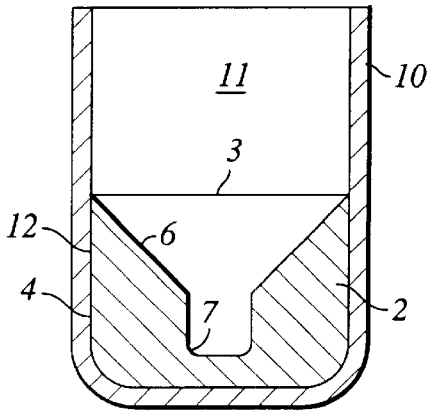
FIG. 2 is a cross-section showing an adapter of the present invention positioned inside a cavity of a centrifuge container.

Referring to FIGS. 1 and 2, a removable adapter 1 embodying the present invention for a centrifuge container 10 comprises a hollow body 2 with an opening 3 for introducing a sample. The body has an exterior surface 4 and an interior surface 5. The interior surface comprises an internal sidewall 6 and a bottom with a pellet well 7. The pellet well 7 extends downwardly, toward the exterior surface 4. Since the purpose of the adapter is to capture substantially all solids from a suspension into the pellet well, it is crucial that the exterior surface 4 completely conforms to the bottom portion 12 of the centrifuge container cavity 11, leaving no substantial gaps for the suspension to seep through.

The shape of the exterior surface 4 of the removable adapter 1 is not crucial, as long as it conforms to the bottom portion of the centrifuge container cavity. For example, as shown by broken lines in FIG. 1, the adapter body may have a conical shape or a cylindrical shape with flat, spherical or conical bottom to match the shape of the internal cavity of the container.

Figure 3:
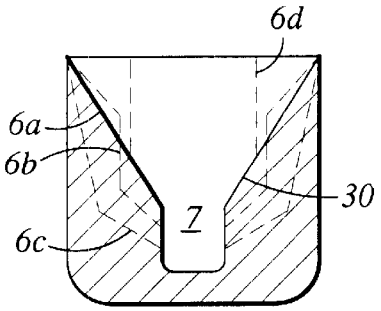
FIG. 3 is a cross-section of the centrifuge container adapter showing various configurations of the inner surface of the adapter in accordance with embodiments of the present invention.

Referring to FIG. 3, the internal sidewall 6*a–d* of the adapter may be of substantially any configuration, as long as it does not restrict the movement of solids toward the pellet well 7. The exact configuration of the internal sidewall is based on the specific handling needs of the suspended materials being pelleted. Preferably, at least a portion of the internal sidewall tapers toward the pellet well to direct solids into the pellet well. Most preferably, the portion of the internal sidewall 30 common with the pellet well 7 tapers toward the pellet well.

In one embodiment, the entire internal sidewall 6*a* tapers from the adapter opening toward the pellet well. The taper may be continuous as in 6*a* or discontinuous as in 6*b* and 6*c*. Although the internal sidewall may have any taper, a taper of about 10 to about 45 degrees is preferred, because less than 10° starts to resemble a flat bottom container where pelleted material fails to move to the lowest point.

Alternatively, the interior surface of the adapter may comprise a plurality of cylindrical and conical internal sidewalls 6*a–d*, formed on top of the other. Some of the sidewalls may have the same taper or they all may have different tapers.

The length of the adapter of the present invention is not critical, as long as at least the bottom portion of the centrifuge container cavity is completely covered by the adapter, and a deposition of solids on the cavity walls during centrifugation is avoided. Consequently, sample volume will affect the choice of the adapter length. For example, in one embodiment shown in FIG. 2, the length of the adapter 1 is smaller than the depth of the centrifuge container cavity 11, however, the bottom portion 12 of the cavity is completely covered by the adapter. Alternatively, the length of the adapter may be equal or larger than the depth of the centrifuge container cavity (not shown). Considering an average length of the centrifuge container to be between 4 and 8 inches, a practical length of the centrifuge container adapter is between 10 and 50 percent of the centrifuge container height.

The pellet well of the adapter of the present invention may have substantially any size as long as it is sufficient to harvest substantially all solids contained in the sample suspension. Consequently, the depth and height of the well may vary, as long as the volume of the well is equivalent to the anticipated solids volume The volume of solids contained in the sample typically range from less than 5% to around 25% of the sample volume. For example, in one embodiment the adapter of the present invention is used to collect mammalian cells from a cell culture with the concentration of cells of about 5%. In this embodiment, the pellet well has a volume of 7 ml.

In order to accommodate various samples and applications, the dimensions of the well and over-all internal configuration of the adapter may be optimized. One skilled in the art can readily determine the suitable internal configuration of the adapter in view of the teaching of the present invention.

The adapter of the present invention may be made of any material, as long as the material substantially maintains its position during centrifugation so that the bottom portion of the centrifuge container cavity remains covered by the adapter at all times. In one embodiment, the adapter is made of a self-supporting material, which does not visibly deform during centrifugation or when removed from the centrifuge container. Examples of such material include, but are not limited to, plastic, laminated paper, and elastomers (rubbers, etc.).

The adapter of the present invention can be easily designed to fit a wide range of centrifuge containers by simply changing the shape and the size of its exterior surface, as shown, for example, in FIG. 1. The adapter can be used with virtually any type of centrifuge container, including, but not limited to, jars, bottles, cups, and tubes for use with any centrifuge. In one embodiment, the adapter is used with centrifuge containers for the swinging bucket rotor centrifuges. In another embodiment, the adapter is used with the centrifuge containers for the fixed angle rotor centrifuge.

Figure 4:
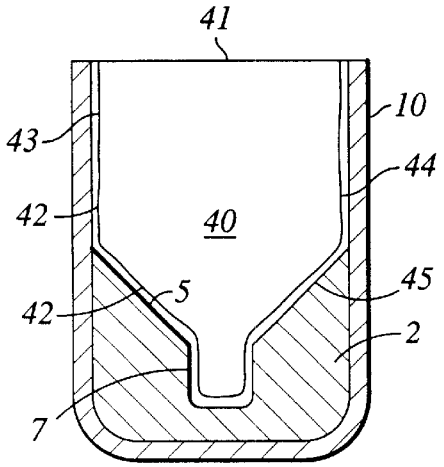
FIGS. 4 and 5 are cross-sections showing an assembly of the adapter and a liner positioned inside a cavity of a centrifuge container according to embodiments of the present invention.
Figure 5:
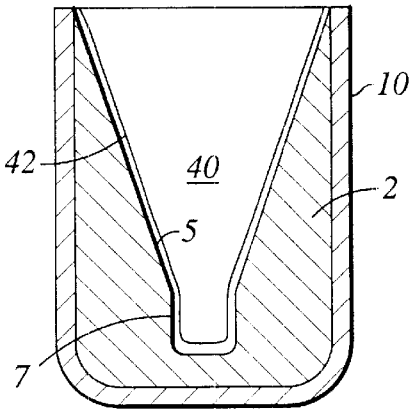

Another aspect of the present invention provides an assembly comprising, as illustrated in FIGS. 4 and 5, the removable adapter with a hollow body 2 and a well 7 described above and a liner 40 with an opening 41 and a side wall 42. When inserted into the adapter, the liner conforms to the shape of the interior surface 5 of the adapter. In some embodiments, the liner is left open after filling with the sample. Alternatively, the liner may be sealed by any method, including, but not limited to, heat sealed, twisted and tied, zip-locked, or pressure sensitive adhesive.

The liner of this invention can be made of any material, flexible, semi-rigid, or rigid, as long as it withstands centrifugation and does not break when the liner is removed from the adapter. For the purpose of this invention, flexible and semi-rigid materials allow a deformation of the liner without breakage, whereas rigid materials do not. A semi-rigid liner of this invention is a free-standing structure that can mainly its 3-D shape outside of the container, both when empty and when filled with a sample. A flexible liner of the present invention, on the other hand, cannot support the weight of a sample on its own outside of the container. Both semi-rigid and flexible hers can be made of a wide range of materials, including, bit not limited to, paper, carton, polyethylene, polyvinylehloride PVC), ethylenevinyl acetate (EVA), urethanes, and vinyls. Rigid liners can be made of plastics, laminated cartons, and multi-layered plastic composites. In one embodiment, the liner is made of a sufficiently resilient material, which allows a reversible deformation of the liner body, as described in co-pending patent application Ser. No. 09/1607,282, filed Jun. 30, 2000, still pending, which has been commonly assigned to the assignee of the present invention and is incorporated by reference herein.

In a preferred embodiment, the liner has a length equal or larger than the depth of the interior surface of the adapter. Such an arrangement prevents the sample from being deposited on the internal surface of the adapter. Most preferably, the length of the liner is sufficient to completely cover both the internal surface 5 of the adapter and any exposed surface of the centrifuge container cavity not covered by the adapter. For example in one embodiment shown in FIG. 4, the length of the adapter is less than the depth of the cavity of the centrifuge container 10. Consequently, a top portion 43 of the centrifuge container cavity is not covered by the adapter. In this embodiment, the liner 40 lines both the exposed portion 43 of the centrifuge container cavity and the internal surface 5 of the adapter. A top part 44 of the liner conforms to the top portion 43 of the centrifuge container cavity and a bottom part 45 conforms to the internal surface 5 of the adapter.

The liner of this invention made of a flexible or a semi-rigid material may conform to the shape of the interior surface of the adapter due to a clinging property of the liner. This liner type provides the advantage of remaining in a fixed position inside the adapter without any additional retaining devices. Alternatively, the liner may conform to the interior surface of the adapter as a result of a hydraulic load created by the sample during its introduction into the liner or during centrifugation. When the liner is made of a rigid material, it is preferred that it has an outwardly extending well for pellet collection mating with the pellet well of the adapter.

As shown in FIGS. 4 and 5, the liner of this invention may be extending beyond the edge of the container opening. The retention of such liners is described in detail in the co-pending patent application Ser. No. 09/607,282, filed Jun. 30, 2000, still pending, referenced above.

In certain applications, it might be desirable to have disposable liners. Because of the simplicity of the construction and the nature of the materials involved, the liner can be made disposable so it can be discarded after use, which eliminates the need for the mechanical cleaning of the centrifuge containers, adapters, and liners. The use of such disposable liners also permits the centrifuge containers to be used with increasing numbers of suspensions, as the difficulties previously encountered in cleaning the containers of certain pelleted solids become obviated when all that is necessary is to dispose of the liner. For additional convenience, the disposable liners can be pre-sterilized by a manufacturer to significantly reduce the time required for the preparation of the centrifuge containers for the aseptic sample processing by an end-user.

Another aspect of this invention is directed to a method of separating solids from suspensions by centrifugation. The method comprises the steps of:

(a) providing a centrifuge container having a cavity with a closed bottom portion and an upper open portion;

(b) providing a removable adapter with a hollow body for receiving a sample, the hollow body having an opening on top, an exterior surface and an interior surface, wherein the exterior surface completely conforms to the bottom portion of the centrifuge container cavity, and the interior surface comprises an internal sidewall and a bottom with a pellet well, wherein the pellet well extends downwardly, toward the exterior surface and the pellet well has a sufficient capacity to retain substantially all solids pelleted by centrifugation;

(c) placing the adapter into the centrifuge container;

(d) placing the suspension into the container;

(e) centrifuging the suspension to form a pellet in the pellet well;

(f) removing the pellet from the pellet well.

As discussed above, substantially any centrifuge container, including, but not limited to, containers used with the swinging bucket rotor and the fixed angle rotor centrifuges, can be used when practicing the present invention.

In accordance with one embodiment of the present invention, this method may further comprise an additional step of placing a liner into the adapter prior to the step of placing the suspension into the container. The liner is designed to conform to the interior surface of the adapter once inside the adapter. When a flexible or a semi-rigid liner is used, the step of placing the liner may be carried out as described in the co-pending patent application Ser. No. 09/607,232, filed Jun. 30, 2000, still pending, referenced above.

After placing the liner into the centrifuge container, a liquid sample may be introduced through the open end of the liner by suitable means to fill the liner. The liner may be fully or partially filled. In some embodiments, the liner is left open after filling with the sample. Alternatively, the liner may be sealed by any method, including, but not limited to, heat sealed, twisted and tied, zip-locked or pressure sensitive adhesive.

The container assembly filled with the sample may be placed into a centrifuge rotor opening directly or via an external adapter. The centrifuge is then operated at a speed and for a period of time necessary to cause the separation of solid and liquid phases. Upon the completion of the centrifugation, a solid pellet is formed in the pellet well of the adapter. When a liner is used, the pellet is formed on a bottom portion of the liner, which covers the pellet well of the adapter. The amount of the pellet and the volume of supernatant obtained depend on the quantity of the sample and the concentration of the solid phase in the sample. The supernatant is usually decanted and the liner with pelleted solids is removed from the adapter. The pelleted material may, if desired, be harvested by scraping or by resuspending in a suitable liquid, such as a buffer solution, salinic solution, water, etc. As the solid recovery efficiency is higher in this method compared to conventional ones, this method is particularly beneficial when solids are harvested from diluted samples.

In one embodiment, the liner is disposable. The disposable liner provides additional advantages of convenience, effectiveness of sample processing and centrifuge container cleaning. Using disposable liners is especially advantageous when processing hazardous materials, for example, biohazardous materials, which require minimal direct exposure of a technician to hazardous pellets. In another embodiment, the disposable liners are pre-sterilized, which significantly simplifies the aseptic sample processing.

The present invention extends to the separation of solids from suspensions. A solid is defined herein as any physically separable matter and includes settable solids, suspended solids, colloidal solids, cells, and formed elements of blood, e.g., platelets, granulocytes (polymorphonuclear), lymphocytes, monocytes, etc. The suspensions can be a wide range of materials, including, but not limited to, biological materials, such as culture media, cell lysates, and bodily fluids (e.g., blood and urine).

Thus, the adapter and the liner of the present invention and the method of their use in separating solids from suspensions are well adapted to attain all of the ends and objects set forth above, together with other advantages which are inherent to the system. The present invention may be embodied in other specific forms without departing from its essential characteristics. The described embodiments are to be considered in all respects only as illustrative and not as restrictive. The scope of the invention is, therefore, indicated by the appended claims rather than by the foregoing description. All changes which come within the meaning and range of the equivalence of the claims are to be embraced within their scope.

What is claimed is:

1. A removable adapter for a centrifuge container, the centrifuge container having a cavity with a closed bottom portion and an open upper portion, the adapter comprising:

a hollow body for receiving a sample, wherein the body has an opening on top, an exterior surface, and an interior surface, wherein:

the exterior surface completely conforms to the bottom portion of the centrifuge container cavity, and the interior surface comprises an internal sidewall and a bottom with a pellet well, wherein the pellet well extends downwardly, toward the exterior surface.

2. The removable adapter of claim 1, wherein at least a portion of the internal sidewall tapers toward the pellet well.

3. The removable adapter of claim 2, wherein the entire internal sidewall of the adapter tapers from the adapter opening toward the pellet well.

4. The removable adapter of claim 3, wherein the internal sidewall has a continuous taper.

5. The removable adapter of claim 3, wherein the taper of the internal sidewall is between about 10 and about 45 degrees.

6. The removable adapter of claim 1, wherein the interior surface comprises a plurality of cylindrical and conical internal sidewalls, formed one on top of the other and having different or same tapers.

7. The removable adapter of claim 1, wherein at least the bottom portion of the container cavity is covered by the adapter.

8. The removable adapter of claim 1, wherein the volume of the pellet well is from about 5 to about 25 ml.

9. The removable adapter of claim 8, wherein the volume of the pellet well is from about 5 to about 7 ml.

10. The removable adapter of claim 1, wherein said adapter is made of a self-supporting material.

11. The removable adapter of claim 1, wherein the adapter is used with a centrifuge container for a swinging bucket rotor.

12. The removable adapter of claim 1, wherein the adapter is used with a centrifuge container for a fixed angle rotor.

13. An assembly for use with a centrifuge container, the centrifuge container having a cavity with a closed bottom portion and an upper open portion, the assembly comprising:

an adapter with a hollow body for receiving a sample, the hollow body having an opening on top, an exterior surface and an interior surface, wherein the exterior surface completely conforms to the bottom portion of the centrifuge container cavity, and the interior surface comprises an internal sidewall and a bottom with a pellet well, wherein the pellet well extends downwardly, toward the exterior surface; and a liner, conforming to the interior surface of the adapter, once inside the adapter.

14. The assembly of claim 13, wherein the liner has a length equal or larger than the depth of the interior surface of the adapter.

15. The assembly of claim 14, wherein the hollow body of the adapter has a length less than the depth of the cavity of the centrifuge container.

16. The assembly of claim 15, wherein the liner has a top part and a bottom part, wherein the bottom part of the liner conforms to the internal surface of the adapter and the top part of the liner conforms to the top portion of the centrifuge container cavity.

17. The assembly of claim 13, wherein the liner is made of a rigid material and has an outwardly extending well for pellet collection mating with the pellet well of the adapter.

18. The assembly of claim 13, wherein the liner is disposable.

19. The assembly of claim 13, wherein the liner is pre-sterilized.

* * * * *

UNITED STATES PATENT AND TRADEMARK OFFICE

CERTIFICATE OF CORRECTION

PATENT NO. : 6,387,030 B1 
DATED : May 14, 2002
INVENTOR(S) : Patrick Q. Moore et al.

It is certified that error appears in the above-identified patent and that said Letters Patent is hereby corrected as shown below:

Column 6,
Line 29, delete "09/607,282" and insert -- 09/607,232 --

Signed and Sealed this

Thirty-first Day of December, 2002

JAMES E. ROGAN
*Director of the United States Patent and Trademark Office*